United States Patent [19]

Maier

[11] 4,416,970

[45] Nov. 22, 1983

[54] USE OF MANGANOUS COMPOUNDS IN IMAGE TRANSFER ELEMENTS

[75] Inventor: Thomas O. Maier, Rochester, N.Y.

[73] Assignee: Eastman Kodak Company, Rochester, N.Y.

[21] Appl. No.: 427,068

[22] Filed: Sep. 29, 1982

[51] Int. Cl.[3] ..... G03C 1/40; G03C 1/10; G03C 7/00; G03C 5/54

[52] U.S. Cl. ..... 430/218; 430/212; 430/214; 430/216; 430/223; 430/237; 430/236; 430/372; 430/447; 430/486; 430/489; 430/490; 430/454

[58] Field of Search ..... 430/212, 214, 216, 218, 430/219, 223, 237, 418, 447, 461, 477, 486, 489, 490, 236, 608, 612, 372, 454

[56] References Cited

U.S. PATENT DOCUMENTS

| | | | |
|---|---|---|---|
| 2,839,405 | 6/1958 | Jones | 430/608 |
| 3,384,483 | 5/1968 | Becker | 430/214 |
| 3,565,622 | 2/1971 | Sincius | 430/464 |
| 3,649,267 | 3/1972 | Carlson et al. | 430/219 |
| 3,720,516 | 3/1973 | Woodward et al. | 430/608 |
| 4,057,427 | 11/1977 | Enriquez | 430/418 |
| 4,152,153 | 5/1979 | Fleckenstein et al. | 430/223 |

FOREIGN PATENT DOCUMENTS

WO80/01962 9/1980 PCT Int'l Appl. .

*Primary Examiner*—Richard Schilling
*Attorney, Agent, or Firm*—Harold E. Cole

[57] ABSTRACT

Image transfer photographic assemblages, processes, compositions and cover sheets are described which employ a manganous compound. After processing, the manganous compound is capable of diffusing to the silver halide emulsion layer and a redox dye-releaser associated therewith to inhibit further dye release. Post-process $D_{min}$ stability is thereby improved.

30 Claims, No Drawings

USE OF MANGANOUS COMPOUNDS IN IMAGE TRANSFER ELEMENTS

This invention relates to photography, and more particularly to photographic assemblages, processes, compositions and cover sheets for color diffusion transfer photography employing at least one silver halide emulsion layer and a redox dye-releaser (RDR) associated thereto. A manganous compound is also employed which is capable of diffusing to the emulsion layer and RDR associated therewith after processing to inhibit further dye release. Post-process $D_{min}$ stability is thereby improved.

Various formats for color, integral transfer elements are described in the prior art, such as U.S. Pat. Nos. 3,415,644; 3,415,645; 3,415,646, 3,647,437; 3,635,707; 3,756,815, and Canadian Pat. Nos. 928,559 and 674,082. In these formats, the image-receiving layer containing the photographic image for viewing remains permanently attached and integral with the image generating and ancillary layers present in the structure when a transparent support is employed on the viewing side of the assemblage. The image is formed by dyes, produced in the image generating units, diffusing through the layers of the structure to the dye image-receiving layer. After exposure of the assemblage, an alkaline processing composition permeates the various layers to initiate development of the exposed photosensitive silver halide emulsion layers. The emulsion layers are developed in proportion to the extent of the respective exposures, and the image dyes which are formed or released in the respective image generating layers begin to diffuse throughout the structure. At least a portion of the imagewise distribution of diffusible dyes diffuses to the dye image-receiving layer to form an image of the original subject.

Other so-called "peel apart" formats for color diffusion transfer assemblages are described, for example, in U.S. Pat. Nos. 2,983,606; 3,362,819 and 3,362,821. In these formats, the image-receiving element is separated from the photosensitive element after development and transfer of the dyes to the image-receiving layer.

In color transfer assemblages such as those described above, a "shut-down" mechanism is needed to stop development after a predetermined time, such as 20 to 60 seconds in some formats, or up to 3 to 10 minutes or more in other formats. Since development occurs at a high pH, it is rapidly slowed by merely lowering the pH. The use of a neutralizing layer, such as a polymeric acid, can be employed for this purpose. Such a layer will stabilize the element after silver halide development and the required diffusion of dyes has taken place. A timing layer is usually employed in conjunction with the neutralizing layer, so that the pH is not prematurely lowered, which would prematurely restrict development and dye release. The development time is thus established by the time it takes the alkaline composition to penetrate through the timing layer. As the system starts to become stabilized, alkali is depleted throughout the structure, causing silver halide development to substantially cease in response to this drop in pH. This may also cause the dye release rate to slow down. For each image generating unit, this shutoff mechanism establishes the amount of silver halide development and the related amount of dye released or formed according to the respective exposure values.

All photographic systems require good image discrimination and low $D_{min}$ values which do not change appreciably with time. In image transfer systems, however, a problem which sometimes occurs is that the $D_{min}$ (and $D_{max}$) continues to increase over a period of time. This is sometimes described in the art as "post-process density increase".

In systems that employ RDR's as the imaging chemistry, oxidation of the RDR causes release of dye in an imagewise manner. The RDR is oxidized by oxidized developing agent or electron transfer agent. However, unwanted dye release could also occur if the RDR is oxidized by other materials in the system such as dissolved oxygen, oxidized interlayer scavengers, etc. This unwanted "post-process density increase" can be lessened as a result of this invention. The use of manganous compound as described herein apparently minimizes the oxidation of residual RDR remaining after processing in both the exposed and nonexposed areas, in one way or another. I do not know the specific mechanism of the functioning of my invention, however.

U.S. Pat. Nos. 3,720,516 and 2,839,405 relate to silver halide emulsions which contain water-soluble manganous salts as emulsion stabilizers or antifoggants. There is no disclosure in these patents, however, that these salts could be located in diffusion transfer assemblages or that they should be so positioned as to diffuse to an emulsion layer and its associated RDR material after processing to lessen post-process $D_{min}$ increase.

U.S. Pat. No. 3,649,267 relates to the use of manganese complexed antifoggant precursors, U.S. Pat. No. 3,565,622 relates to the use of a manganese compound as a developing agent and WO/01962 relates to the use of manganous salts to protect silver images from peroxide attack. There is no disclosure in these patents, however, of the use of manganous compounds in diffusion transfer systems as described herein.

SUMMARY OF THE INVENTION

A photographic assemblage in accordance with my invention comprises:

(a) a photosensitive element comprising a support having thereon at least one silver halide emulsion layer having associated therewith a redox dye-releasing material;

(b) a dye image-receiving layer; and (c) an alkaline processing composition and means containing same for discharge within the assemblage;

and wherein the assemblage contains a manganous compound that is capable of diffusing to the emulsion layer and the redox dye-releasing material associated therewith after processing of the assemblage.

The manganous compound can be located anywhere in the assemblage other than the photosensitive portion of the photosensitive element. It can be located, for example, in the dye image-receiving layer, the processing composition, a cover sheet, an opaque layer, etc. During processing with the alkaline processing composition, the soluble manganous compound is converted to an insoluble form, believed to be $Mn(OH)_2$. This insoluble form does not diffuse to the photosensitive portion of the photosensitive element. After processing, however, the pH is lowered and the manganous hydroxide is solubilized and then diffuses to the photosensitive portion of the photosensitive element. The effect it has is to inhibit further dye release or dye diffusion and thereby improve post-process $D_{min}$ stability.

DETAILED DESCRIPTION OF THE INVENTION

In a preferred embodiment of my invention the photographic assemblage comprises:

(a) a photosensitive element comprising a support having thereon at least one silver halide emulsion layer having associated therewith a RDR material;

(b) a transparent cover sheet located over the layer outermost from the support of the photosensitive element;

(c) a dye image-receiving layer located either in the photosensitive element or on the transparent cover sheet; and (d) an alkaline processing composition and means containing same for discharge between the photosensitive element and the transparent cover sheet;

and wherein either the transparent cover sheet or the alkaline processing composition contains a manganous compound.

If the manganese compound is located in the processing composition in this embodiment, then the insoluble $Mn(OH)_2$ is formed right away. If the manganese compound is located on the cover sheet, then the insoluble $Mn(OH)_2$ precipitate will form there during processing. In either case, a soluble manganous species is formed after the pH drops which is then capable of diffusing to the photosensitive element to provide the beneficial effects described above.

When the manganous compound is located on the cover sheet, it may be employed in any amount which is effective for the intended purpose. In general, good results have been obtained at concentrations ranging from about 0.005 to about 2 $g/m^2$ of cover sheet.

When the manganous compound is located in the processing composition, it may also be employed in any concentration which is effective for the intended purpose. In general, good results have been obtained at concentrations ranging from about 0.01 to about 30 g/l of processing composition, preferably from about 1 to about 5 g/l.

Any manganous compound may be employed in my invention as long as it provides the beneficial results described above. There may be employed, for example, manganous chloride, manganous fluoride, manganous bromide, manganous nitrate, manganous acetate, manganous tartrate, manganous citrate, manganous benzoate, manganous lactate, manganous formate, or manganous sulfate. Especially good results have been obtained with manganous chloride and manganous fluoride.

One of the most important advantages of this invention is that post-process $D_{min}$ stability is obtained without any adverse sensitometric, physical or dye stability effects. A relatively small quantity of an inexpensive and innocuous manganous compound can be easily incorporated into the system. Although the effect on $D_{min}$ stability may appear to be small, any lessening of the problem, however slight, is valued, provided no new problems are created.

In a preferred embodiment of the invention, the means containing the alkaline processing composition is a rupturable container or pod which is adapted to be positioned during processing of the film unit so that a compressive force applied to the container by pressure-applying members, such as would be found in a camera designed for in-camera processing, will effect a discharge of the container's contents within the film unit. In general, the processing composition employed in this invention contains the developing agent for development, although the composition could also just be an alkaline solution where the developer is incorporated in the photographic element or cover sheet, in which case the alkaline solution serves to activate the incorporated developer.

The redox dye-releasing (RDR) materials or compounds useful in this invention are well known to those skilled in the art and are, generally speaking, ballasted compounds which will react with oxidized or unoxidized developing agent or electron transfer agent (ETA) to release a dye. Such nondiffusible RDR's include positive-working compounds, as described in U.S. Pat. Nos. 3,980,479; 4,139,379; 4,139,389; 4,199,354 and 4,199,355, the disclosures of which are hereby incorporated by reference. Such nondiffusible RDR's also include negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; German Pat. Nos. 2,505,248 and 2,729,820; *Research Disclosure* 15157, November 1976 and *Research Disclosure* 15654, April 1977, the disclosures of which are hereby incorporated by reference.

In a preferred embodiment of the invention, the dye-releasers such as those in the Fleckenstein et al patent referred to above are employed. Such compounds are ballasted sulfonamido compounds which are alkali-cleavable upon oxidation to release a diffusible dye from the nucleus and have the formula:

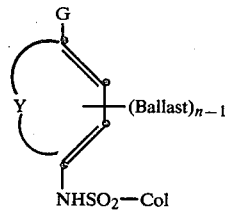

wherein:

(a) Col is a dye or dye precursor moiety;

(b) Ballast is an organic ballasting radical of such molecular size and configuration (e.g., simple organic groups or polymeric groups) as to render the compound nondiffusible in the photosensitive element during development in an alkaline processing composition;

(c) G is $OR_1$ or $NHR_2$ wherein $R_1$ is hydrogen or a hydrolyzable moiety and $R_2$ is hydrogen or a substituted or unsubstituted alkyl group of 1 to 22 carbon atoms, such as methyl, ethyl, hydroxyethyl, propyl, butyl, secondary butyl, tertiary butyl, cyclopropyl, 4-chlorobutyl, cyclobutyl, 4-nitroamyl, hexyl, cyclohexyl, octyl, decyl, octadecyl, docosyl, benzyl or phenethyl (when $R_2$ is an alkyl group of greater than 6 carbon atoms, it can serve as a partial or sole Ballast group);

(d) Y represents the atoms necessary to complete a benzene nucleus, a naphthalene nucleus or a 5- to 7-membered heterocyclic ring such as pyrazolone or pyrimidine; and (e) n is a positive integer or 1 or 2 and is 2 when G is $OR_1$ or when $R_2$ is a hydrogen or an alkyl group of less than 8 carbon atoms.

For further details concerning the above-described sulfonamido compounds and specific examples of same, reference is made to the above-mentioned Fleckenstein et al U.S. Pat. No. 4,076,529 referred to above.

In another preferred embodiment of the invention, positive-working, nondiffusible RDR's of the type disclosed in U.S. Pat. Nos. 4,139,379 and 4,139,389 are employed. In this embodiment, an immobile compound is employed which as incorporated in a photographic element is incapable of releasing a diffusible dye. However, during photographic processing under alkaline conditions, the compound is capable of accepting at least one electron (i.e., being reduced) and thereafter releases a diffusible dye. These immobile compounds are ballasted electron accepting nucleophilic displacement compounds.

The dye image-receiving layer in the above-described film assemblage is optionally located on a separate support adapted to be superposed on the photographic element after exposure thereof. Such image-receiving elements are generally disclosed, for example, in U.S. Pat. No. 3,362,819. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

In another embodiment, the dye image-receiving layer in the above-described film assemblage is located integral with the photographic element and is located between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention is useful is disclosed in Canadian Pat. No. 928,559. In this embodiment, the support for the photographic element is transparent and is coated with the image-receiving layer, a substantially opaque, light-reflective layer and the photosensitive layer or layers described above. A rupturable container, containing an alkaline processing composition including an ETA and an opacifier, is positioned between the top layer and a transparent cover sheet which has thereon, in sequence, a neutralizing layer, and a timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Canadian Pat. No. 928,559.

Still other useful integral formats in which this invention can be employed are described in U.S. Pat. Nos. 3,415,644; 3,415,645; 3,415,646; 3,647,437 and 3,635,707. In most of these formats, a photosensitive silver halide emulsion is coated on an opaque support and a dye image-receiving layer is located on a separate transparent support superposed over the layer outermost from the opaque support. In addition, this transparent support also contains a neutralizing layer and a timing layer underneath the dye image-receiving layer.

In another embodiment of the invention, the neutralizing layer and timing layer are located underneath the photosensitive layer or layers. In that embodiment, the photosensitive element would comprise a support having thereon, in sequence, a neutralizing layer, a timing layer and at least one photosensitive silver halide emulsion layer having associated therewith an RDR. The dye image-receiving layer would be provided on transparent cover sheet with the processing composition being applied therebetween. This format could either be peel-apart or integral, as described above.

A process in accordance with the invention for producing a photographic transfer image in color from an imagewise-exposed photosensitive element comprising a support having thereon at least one silver halide emulsion layer having associated therewith a RDR comprises treating the element with an alkaline processing composition in the presence of a silver halide developing agent to effect development of each of the exposed silver halide emulsion layers, whereby an imagewise distribution of RDR is formed as a function of development and at least a portion of it diffuses to a dye-image-receiving layer to provide the transfer image, and wherein a manganous compound is diffused to the emulsion layer and RDR associated therewith after processing of the assemblage to minimize additional dye release after termination of development.

The film unit or assemblage of the present invention is used to produce positive images in single or multicolors. In a three-color system, each silver halide emulsion layer of the film assembly will have associated therewith an RDR which possesses a predominant spectral absorption within the region of the visible spectrum to which said silver halide emulsion is sensitive, i.e., the blue-sensitive silver halide emulsion layer will have a yellow RDR associated therewith, the green-sensitive silver halide emulsion layer will have a magenta RDR associated therewith and the red-sensitive silver halide emulsion layer will have a cyan RDR associated therewith. The RDR associated with each silver halide emulsion layer is contained either in the silver halide emulsion layer itself or in a layer contiguous to the silver halide emulsion layer, i.e., the RDR can be coated in a separate layer underneath the silver halide emulsion layer with respect to the exposure direction.

The concentration of the RDR material that is employed in the present invention can be varied over a wide range, depending upon the particular compound employed and the results desired. For example, the RDR material coated in a layer at a concentration of 0.1 to 3 g/m$^2$ has been found to be useful. The RDR material is usually dispersed in a hydrophilic film forming natural material or synthetic polymer, such as gelatin, polyvinyl alcohol, etc, which is adapted to be permeated by aqueous alkaline processing composition.

A variety of silver halide developing agents are useful in this invention. Specific examples of developers or electron transfer agents (ETA's) useful in this invention include hydroquinone compounds, such as hydroquinone, 2,5-dichlorohydroquinone or 2-chlorohydroquinone; aminophenol compounds, such as 4-aminophenol, N-methylaminophenol, N,N-dimethylaminophenol, 3-methyl-4-aminophenol or 3,5-dibromoaminophenol; catechol compounds, such as catechol, 4-cyclohexylcatechol, 3-methoxycatechol, or 4-(N-octadecylamino)-catechol; or phenylenediamine compounds such as N,N,N'N'-tetramethyl-p-phenylenediamine. In highly preferred embodiments, the ETA is a 3-pyrazolidinone compound, such as 1-phenyl-3-pyrazolidinone (Phenidone), 1-phenyl-4,4-dimethyl-3-pyrazolidinone (Dimezone), 4-hydroxymethyl-4-methyl-1-phenyl-3-pyrazolidinone, 4-hydroxymethyl-4-methyl-1-p-tolyl-3-pyrazolidinone, 4-hydroxymethyl-4-methyl-1-(3,4-dimethylphenyl)3-pyrazolidinone, 1-m-tolyl-3-pyrazolidinone, 1-p-tolyl-3-pyrazolidinone, 1-phenyl-4-methyl-3-pyrazolidinone, 1-phenyl-5-methyl-3-pyrazolidinone, 1-phenyl-4,4-dihydroxymethyl-3-pyrazolidinone, 1,4-di-methyl-3-pyrazolidinone, 4-methyl-3-pyrazolidinone, 4,4-dimethyl-3-pyrazolidinone, 1-(3-chlorophenyl)-4-methyl-3-pyrazolidinone, 1-(4-chlorophenyl)-4-methyl-3-pyrazolidinone, 1-(3-chlorophenyl)-3-pyrazolidinone, 1-(4-chlorophenyl)-3-pyrazolidinone, 1-(4-tolyl)-4-methyl-3-pyrazolidinone, 1-(2-tolyl)-4-methyl-3-pyrazolidinone, 1-(4-tolyl)-3-pyrazolidinone, 1-(3-tolyl)-3-pyrazolidinone, 1-(3-tolyl)-4,4-dimethyl-3-pyrazolidinone, 1-(2-trifluoroethyl)-4,4-dimethyl-3-pyrazolidinone or 5-methyl-3-pyrazolidinone. A combination of different ETA's, such as those disclosed in U.S. Pat. No. 3,039,869, can also be employed. These ETA's are employed in the liquid processing composition or contained, at least in part, in any layer or layers of the photographic element or film assemblage to be activated by the alkaline processing composition, such as in the silver halide emulsion layers, the RDR layers, interlayers, image-receiving layer, etc.

In this invention, in which RDR materials can be used which produce diffusible dye images as a function of development, either conventional negative-working or direct-positive silver halide emulsions can be employed. If the silver halide emulsion employed is a direct-positive silver halide emulsion, such as an internal image emulsion designed for use in the internal image reversal process, or a fogged, direct-positive emulsion such as a solarizing emulsion, which is developable in unexposed areas, a positive image can be obtained on the dye image-receiving layer by using ballasted RDR's. After exposure of the film assemblage or unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the RDR compounds and the oxidized form of the compounds then undergoes a base-initiated reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a neutralizing layer in the film unit or image-receiving unit lowers the pH of the film unit or image receiver to stabilize the image.

Internal image silver halide emulsions useful in this invention are described more fully in the November, 1976 edition of *Research Disclosure,* pages 76 through 79, the disclosure of which is hereby incorporated by reference.

The various silver halide emulsion layers of a color film assembly employed in this invention are disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that is transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention is disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye image-providing RDR materials are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of *Research Disclosure,* the disclosure of which is hereby incorporated by reference.

Any material is useful as the image-receiving layer in this invention, as long as the desired function of mordanting or otherwise fixing the dye images is obtained. The particular material chosen will, of course, depend upon the dye to be mordanted. Suitable materials are disclosed on pages 80 through 82 of the November 1976 edition of *Research Disclosure,* the disclosure of which is hereby incorporated by reference.

Use of a neutralizing material in the film units employed in this invention will usually increase the stability of the transferred image. Generally, the neutralizing material will effect a reduction in the pH of the image layer from about 13 or 14 to at least 11 and preferably 5 to 8 within a short time after imbibition. Suitable materials and their functioning are disclosed on pages 22 and 23 of the July 1974 edition of *Research Disclosure,* and pages 35 through 37 of the July 1975 edition of *Research Disclosure,* the disclosures of which are hereby incorporated by reference.

A timing or inert spacer layer can be employed in the practice of this invention over the neutralizing layer which "times" or controls the pH reduction as a function of the rate at which alkali diffuses through the inert spacer layer. Examples of such timing layers and their functioning are disclosed in the *Research Disclosure* articles mentioned in the paragraph above concerning neutralizing layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. In certain embodiments of our invention, the manganous compounds may be contained in the processing composition, also. Suitable materials and addenda frequently added to such compositions are disclosed on pages 79 and 80 of the November, 1976 edition of *Research Disclosure,* the disclosure of which is hereby incorporated by reference.

The alkaline solution permeable, substantially opaque, light-reflective layer employed in certain embodiments of photographic film units used in this invention is described more fully in the November, 1976 edition of *Research Disclosure,* page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November, 1976 edition of *Research Disclosure,* the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone. In an alternative embodiment, the emulsions sensitive to each of the three primary regions of the spectrum can be disposed as a single segmented layer, e.g., as by the use of microvessels, as described in Whitmore U.S. patent application Ser. No. 184,714, filed Sept. 8, 1980.

The silver halide emulsion useful in this invention, both negative-working and direct-positive ones, are well known to those skilled in the art and are described in *Research Disclosure,* Volume 176, December, 1978, Item 17643, pages 22 and 23, "Emulsion preparation and types"; they are usually chemically and spectrally sensitized as described on page 23, "Chemical sensitization", and "Spectral sensitization and desensitization", of the above article; they are optionally protected against the production of fog and stabilized against loss of sensitivity during keeping by employing the materials described on pages 24 and 25, "Antifoggants and stabilizers", of the above article; they usually contain hardeners and coating aids as described on page 26, "Hardeners", and pages 26 and 27, "Coating aids", of the above article; they and other layers in the photographic elements used in this invention usually contain plasticizers, vehicles and filter dyes described on page 27, "Plasticizers and lubricants"; page 26, "Vehicles and vehicle extenders"; and pages 25 and 26, "Absorbing and scattering materials", of the above article; they and other layers in the photographic elements used in this invention can contain addenda which are incorporated by using the procedures described on page 27, "Methods of addition", of the above article; and they are usually coated and dried by using the various techniques described on pages 27 and 28, "Coating and drying procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers, so long as the materials are accessible to one another.

The following examples are provided to further illustrate the invention.

EXAMPLE 1

Manganous Compound in Processing Composition

A cover sheet was prepared by coating the following layers, in the order recited, on a poly(ethylene terephthalate) film support:

(1) an acid layer comprising poly(n-butyl acrylate-co-acrylic acid), (30:70 weight ratio equivalent to 140 meq. acid/$m^2$); and (2) a timing layer comprising 5.4 g/$m^2$ of a 1:1 physical mixture by weight of poly(acrylonitrile-co-vinylidene chloride-co-acrylic acid latex) (weight ratio of 14/80/6) and a carboxy ester lactone formed by cyclization of a vinyl acetate-maleic anhydride copolymer in the presence of 1-butanol to produce a partial butyl ester, ratio of acid:ester of 15:85; 0.22 g/$m^2$ of t-butylhydrohydroquinone monoacetate; and 0.16 g/m$^2$ of 5-phthalimidomethylthio)-1-phenyl-1-H-tetrazole;

(3) gelatin layer (3.8 g/m$^2$) hardened at one percent with bis(vinylsulfonyl)methyl ether; and (4) heat-sealing layer of 0.97 g/m$^2$ of poly(acrylonitrile-co-vinylidene chloride-co-acrylic acid) latex (14:80:6 weight ratio).

An integral imaging-receiver (IIR) element was prepared by coating the following layers in the order recited on a transparent poly(ethylene terephthalate) film support. Quantities are parenthetically given in grams per square meter, unless otherwise stated.

(1) image-receiving layer of poly(styrene-co-N-benzyl-N,N-dimethyl-N-vinylbenzylammonium chloride-co-divinylbenzene (molar ratio 49/49/2) (2.3) and gelatin (2.3);

(2) reflecting layer of titanium dioxide (16.0) and gelatin (2.6);

(3) opaque layer of carbon black (1.9), gelatin (1.2), oxidized developer scavenger 2-(2-octadecyl)-5-sulfohydroquinone potassium salt (0.02) and cyan RDR A (0.02) dispersed in N-n-butylacetanilide;

(4) interlayer of gelatin (0.54)

(5) cyan dye-providing layer of gelatin (0.44) and cyan RDR B (0.32) dispersed in N-n-butylacetanilide;

(6) interlayer of gelatin (0.43) and bis(vinylsulfonyl)methane (0.050)

(7) red-sensitive, direct-positive silver bromide emulsion (1.4 silver), gelatin (0.91), Nucleating Agent B (1.4 mg/Ag mole), 2-(2-octadecyl)5-sulfohydroquinone potassium salt (0.17);

(8) interlayer of gelatin (1.1) and 2,5-di-sec-dodecylhydroquinone (1.2);

(9) magenta dye-providing layer of magenta RDR C (0.43) dispersed in diethyllauramide) and gelatin (0.86);

(10) interlayer of gelatin (0.81);

(11) green-sensitive, direct-positive silver bromide emulsion (0.92 silver), gelatin (0.91), Nucleating Agent A (66 mg/Ag mole), Nucleating Agent B (0.76 mg/Ag mole), and 2-(2-octadecyl)5-sulfohydroquinone potassium salt (0.043);

(12) interlayer of green-sensitive negative silver bromide emulsion (0.05 Ag), gelatin (1.1) and 2,5-di-sec-dodecylhydroquinone (1.1);

(13) yellow dye-providing layer of yellow RDR D (0.54) dispersed in di-n-butyl phthalate, gelatin (1.2) and bis(vinylsulfonyl)methane (0.057);

(14) blue-sensitive, direct-positive silver bromide emulsion (0.91 silver), gelatin (0.91), Nucleating Agent A (75 mg/Ag mole), Nucleating Agent B (1.1 mg/Ag mole), 2-(2-octadecyl)-5-sulfohydroquinone potassium salt (0.43) and t-butylhydroquinone monoacetate (0.016); and

(15) overcoat layer of gelatin (0.89) and 2,5-di-sec-dodecylhydroquinone (0.11).

The direct-positive emulsions are approximately 0.8$\mu$ monodispersed, octahedral, internal image silver bromide emulsions, as described in U.S. Pat. No. 3,923,513.

CYAN RDR A

-continued

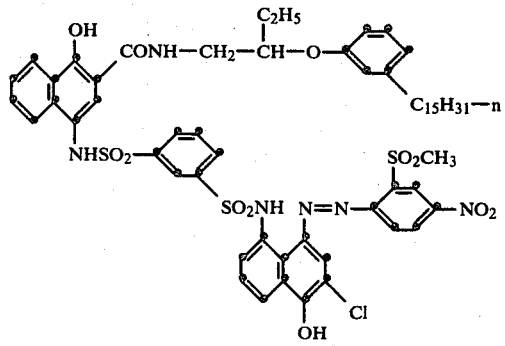

CYAN RDR B

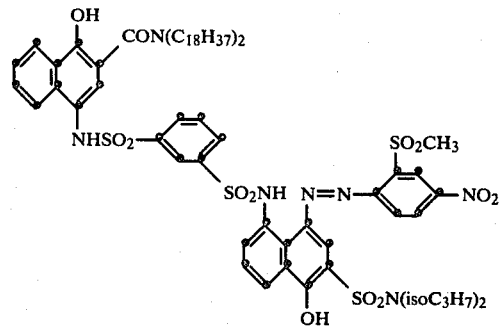

MAGENTA RDR C

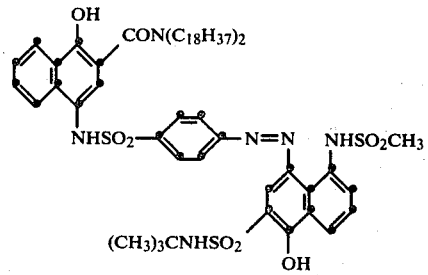

YELLOW RDR D

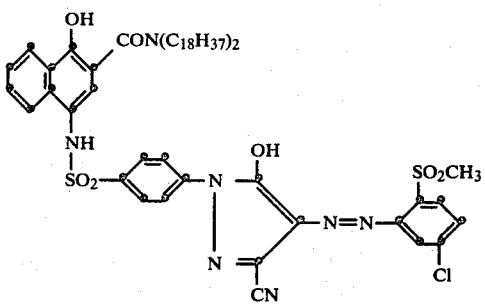

Nucleating Agent A

-continued

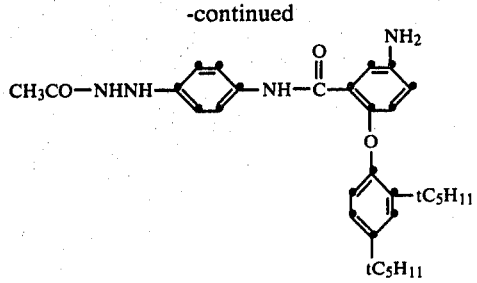

Nucleating Agent B

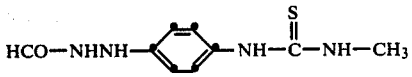

A sample of the IIR was exposed in a sensitometer through a graduated density test object to yield a neutral at a Status A density of 1.0. The exposed sample was then processed at 21° C. by rupturing a pod containing the viscous processing composition described below between the IIR and the cover sheet described above, by using a pair of juxtaposed rollers to provide a processing gap of about 65 μm.

The processing composition was as follows:

| | |
|---|---|
| 52.2 g | potassium hydroxide |
| 12 g | 4-methyl-4-hydroxymethyl-1-p-tolyl-3-pyrazolidinone |
| 1.5 g | 1,4-cyclohexanedimethanol |
| 4 g | 5-methylbenzotriazole |
| 1 g | potassium sulfite |
| 6.4 g | Tamol SN ® dispersant |
| 10 g | potassium fluoride |
| 46 g | carboxymethylcellulose |
| 192 g | carbon |
| | water to 1 liter |

The above procedure was repeated with the exception that the processing composition had added to it $MnCl_2.4H_2O$ (5 g/l).

After a period of not less than an hour, the "fresh" sensitometry of the resulting image was obtained with particular reference to noting the $D_{min}$. The fresh sensitometric parameters ($D_{max}$, $D_{min}$, contrast and speed) with and without the manganous compound were equivalent. Samples of the IIR were then incubated under the test conditions as set forth in Table 1 and the density was reread to determine the $D_{min}$ change. The following results were obtained:

TABLE 1

| $MnCl_2.4H_2O$ in Processing Composition | | Fresh $D_{min}$ | $D_{min}$ Change from Fresh Reading After Incubation For: 2 weeks 32° C./70% RH | 3 weeks 32° C./15% RH | 6 weeks 22° C. |
|---|---|---|---|---|---|
| None (control) | R | 0.21 | +0.03 | +0.03 | +0.01 |
| | G | 0.20 | +0.01 | +0.02 | +0.01 |
| | B | 0.20 | +0.05 | +0.04 | +0.03 |
| 5.0 g/l | R | 0.21 | +0.04 | +0.01 | +0.01 |
| | G | 0.19 | +0.02 | +0.01 | 0 |
| | B | 0.20 | +0.03 | +0.01 | +0.01 |

The above results indicate that the $D_{min}$ changes, especially blue $D_{min}$, of the IIR are smaller when manganous chloride is incorporated into the processing composition.

EXAMPLE 2

Manganous Compound in Processing Composition

Example 1 is repeated except that layer 13 additionally contained 0.2 g/m² zinc oxide and the receiving layer 1 contained 4.8 g/m² of the mordant poly(styrene-co-1-vinylimidazole-co-3-benzyl-1-vinylimidazolium chloride) (50/40/10 molar ratio) instead of the mordant listed therein. The following results were obtained:

TABLE 2

| $MnCl_2.4H_2O$ in Processing Composition | | Fresh $D_{min}$ | $D_{min}$ Change from Fresh Reading After Incubation For: 2 weeks 32° C./70% RH | 3 weeks 32° C./15% RH | 6 weeks 22° C. |
|---|---|---|---|---|---|
| None (control) | R | 0.21 | +0.04 | +0.06 | +0.02 |
| | G | 0.20 | +0.03 | +0.06 | 0 |
| | B | 0.20 | +0.08 | +0.09 | +0.05 |
| 5.0 g/l | R | 0.21 | +0.04 | +0.02 | +0.03 |
| | G | 0.20 | 0 | +0.02 | +0.01 |
| | B | 0.20 | +0.04 | +0.03 | +0.03 |

The above data show corresponding or greater improvements in $D_{min}$ stability, as compared to Example 1. Thus, the $D_{min}$ stability improvement is not specific to only one mordant.

EXAMPLE 3

Concentration Series of Manganous Compounds

Example 1 is repeated except that different amounts of manganous chloride and manganous fluoride were used in the processing composition as set forth in Table 3 below (when manganous fluoride was used, the amount of potassium fluoride was proportionately reduced to keep the same total fluoride ion concentration in the pod). After the fresh sensitometry was obtained, the samples were incubated at 32° C./15% RH for 3 weeks. The $D_{min}$ difference between the control and the experimental processing compositions containing a manganous compound after incubation were then measured as follows:

TABLE 3

| Experimental Processing Composition Containing Manganous Compound | | Difference in $D_{min}$ Between Control and Experimental Processing Composition After Incubation: Red | Green | Blue |
|---|---|---|---|---|
| $MnF_2$ | 1 g/l | −0.01 | −0.02 | −0.03 |
| $MnF_2$ | 2 g/l | −0.01 | −0.02 | −0.03 |
| $MnF_2$ | 3 g/l | −0.01 | −0.02 | −0.03 |
| $MnCl_2.4H_2O$ | 1 g/l | −0.01 | −0.02 | −0.03 |
| $MnCl_2.4H_2O$ | 2 g/l | −0.02 | −0.03 | −0.04 |
| $MnCl_2.4H_2O$ | 3 g/l | −0.02 | −0.03 | −0.04 |
| $MnCl_2.4H_2O$ | 5 g/l | −0.02 | −0.02 | −0.03 |

The above results indicate that as little as 1 g/l of $MnF_2$ or 1–2 g/l of $MnCl_2.4H_2O$ produces a significant $D_{min}$ improvement.

EXAMPLE 4

Manganous Compounds in the Cover Sheet

Cover sheets similar to those of Example 1 were prepared except that various quantities of manganous chloride were added to the gelatin layer (3) or acid layer (1) as specified in Table 4 below. An IIR and processing composition without a manganous salt were prepared similar to those of Example 1.

The same experimental procedure of exposure and processing was used as in Example 1. The $D_{min}$ of the IIR was read not less than 1 hour after processing to obtain the "fresh" $D_{min}$ and the same area was read again after 2 weeks incubation at 35° C./50% RH. Each sample was run in duplicate. No significant differences were observed for the fresh or incubated red or green densities. The following results were obtained:

TABLE 4

| $MnCl_2.4H_2O$ in Cover Sheet (g/m²) | Blue $D_{min}$ Fresh | Incubated | Δ |
|---|---|---|---|
| None (control) | 0.19 | 0.25 | +0.06 |
| | 0.20 | 0.25 | +0.05 |
| In Gelatin Layer (0.16) | 0.19 | 0.23 | +0.04 |
| | 0.19 | 0.23 | +0.04 |
| In Acid Layer (0.16) | 0.20 | 0.23 | +0.03 |
| | 0.20 | 0.23 | +0.03 |
| In Acid Layer (0.54) | 0.20 | 0.23 | +0.03 |
| | 0.20 | 0.23 | +0.03 |
| In Acid Layer (1.1) | 0.19 | 0.23 | +0.04 |
| | 0.19 | 0.23 | +0.04 |

The above data indicate that the blue $D_{min}$ increase is less with the manganous compound in either location in the cover sheet than with the control.

The change in density after incubation from an initial "fresh" density of 1.0 was also determined as follows:

TABLE 5

| $MnCl_2.4H_2O$ in Cover Sheet (g/m²) | Density Change after Incubation at Initial 1.0 Density Red | Green | Blue |
|---|---|---|---|
| None (control) | +0.09 | +0.07 | +0.11 |
| | +0.08 | +0.07 | +0.10 |
| In Gelatin Layer (0.16) | +0.07 | +0.07 | +0.09 |
| | +0.07 | +0.06 | +0.08 |
| In Acid Layer (0.16) | +0.07 | +0.05 | +0.08 |
| | +0.07 | +0.06 | +0.09 |
| In Acid Layer (0.54) | +0.06 | +0.05 | +0.07 |
| | +0.05 | +0.05 | +0.07 |
| In Acid Layer (1.1) | +0.05 | +0.04 | +0.04 |
| | +0.05 | +0.04 | +0.04 |

The above data indicate that the cover sheets containing the manganous compound have less post-process diffusion of all three dyes in the midscale density region.

The invention has been described in detail with particular reference to preferred embodiments thereof, but it will be understood that variations and modifications can be effected within the spirit and scope of the invention.

What is claimed is:

1. In a photographic assemblage comprising:
(a) a photosensitive element comprising a support having thereon at least one silver halide emulsion layer having associated therewith a redox dye-releasing material;
(b) a dye image-receiving layer; and
(c) an alkaline processing composition and means containing same for discharge within said assemblage;
the improvement wherein said assemblage contains a manganous compound that is capable of diffusing to said emulsion layer and said redox dye-releasing material associated therewith only after processing and lowering of the pH of said assemblage, said manganous compound not being initially located in the photosensitive portion of said photosensitive element.

2. In a photographic assemblage comprising:
(a) a photosensitive element comprising a support having thereon at least one silver halide emulsion layer having associated therewith a redox dye-releasing material;
(b) a transparent cover sheet located over the layer outermost from said support of said photosensitive element;
(c) a dye image-receiving layer located either in said photosensitive element or on said transparent cover sheet; and
(d) an alkaline processing composition and means containing same for discharge between said photosensitive element and said transparent cover sheet;
the improvement wherein either said transparent cover sheet or said alkaline processing composition contains a manganous compound that is capable of diffusing to said emulsion layer and said redox dye-releasing material associated therewith only after processing and lowering of the pH of said assemblage.

3. The photographic assemblage of claim 2 wherein said manganous compound is located on said transparent cover sheet.

4. The photographic assemblage of claim 3 wherein said compound is present at a concentration of from about 0.005 to about 2 g/m² of cover sheet.

5. The photographic assemblage of claim 2 wherein said manganous compound is located in said alkaline processing composition.

6. The photographic assemblage of claim 5 wherein said compound is present at a concentration of from about 0.01 to about 30 g/l of processing composition.

7. The photographic assemblage of claim 2 wherein said manganous compound is manganous chloride, manganous fluoride, manganous bromide, manganous nitrate, manganous acetate, manganous tartrate, manganous citrate, manganous benzoate, manganous lactate, manganous formate, or manganous sulfate.

8. The photographic assemblage of claim 2 wherein said manganous compound is manganous chloride.

9. The photographic assemblage of claim 2 wherein said manganous compound is manganous fluoride.

10. The photographic assemblage of claim 2 wherein said photosensitive element comprises a support having thereon a red-sensitive silver halide emulsion layer having a cyan redox dye-releaser associated therewith, a green-sensitive silver halide emulsion layer having a magenta redox dye-releaser associated therewith, and a blue-sensitive silver halide emulsion layer having a yellow redox dye-releaser associated therewith.

11. The photographic assemblage of claim 2 wherein:
(a) said dye image-receiving layer is located in said photosensitive element between said support and said silver halide emulsion layer; and
(b) said transparent cover sheet has thereon, in sequence, a neutralizing layer and a timing layer.

12. The photographic assemblage of claim 2 wherein said discharging means is a rupturable container containing said alkaline processing composition and an opacifying agent.

13. The photographic assemblage of claim 2 wherein said support having thereon said photosensitive silver halide emulsion layer is opaque and said dye image-receiving layer is located on said transparent cover sheet.

14. The photographic assemblage of claim 13 wherein said transparent cover sheet has thereon, in sequence, a neutralizing layer, a timing layer and said dye image-receiving layer.

15. The photographic assemblage of claim 13 wherein said opaque support has thereon, in sequence, a neutralizing layer, a timing layer and said silver halide emulsion layer.

16. The photographic assemblage of claim 2 wherein said redox dye-releasing material has the following formula:

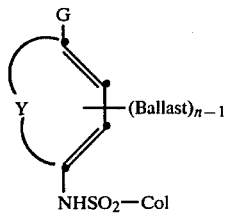

wherein:

(a) Col is a dye or dye precursor moiety;

(b) Ballast is an organic ballasting radical of such molecular size and configuration as to render said material nondiffusible in said photosensitive element during development in said alkaline processing composition;

(c) G is $OR_1$ or $NHR_2$ wherein $R_1$ is hydrogen or a hydrolyzable moiety and $R_2$ is hydrogen or a substituted or unsubstituted alkyl group of 1 to about 22 carbon atoms;

(d) Y represents the atoms necessary to complete a benzene nucleus, a naphthalene nucleus or a 5- to 7-membered heterocyclic ring; and (e) n is a positive integer of 1 to 2 and is 2 when G is $OR_1$, or when $R_2$ is hydrogen or an alkyl group of less than 8 carbon atoms.

17. In an integral photographic assemblage comprising:

(a) a photosensitive element comprising a transparent support having thereon the following layers in sequence: a dye image-receiving layer, an alkaline solution-permeable, light-reflective layer, an alkaline solution-permeable, opaque layer, a red-sensitive silver halide emulsion layer having a cyan redox dye-releaser associated therewith, a green-sensitive silver halide emulsion layer having a magenta redox dye-releaser associated therewith, and a blue-sensitive silver halide emulsion layer having a yellow redox dye-releaser associated therewith;

(b) a transparent cover sheet superposed over said blue-sensitive silver halide emulsion layer and comprising a transparent support having thereon, in sequence, a neutralizing layer and a timing layer; and (c) a rupturable container containing an alkaline processing composition and an opacifying agent which is so positioned during processing of said assemblage that a compressive force applied to said container will effect a discharge of the container's contents between said transparent cover sheet and said blue-sensitive silver halide emulsion layer; said assemblage containing a silver halide developing agent;

the improvement wherein said transparent cover sheet of said rupturable container contains a manganous compound that is capable of diffusing to said emulsion layers and said redox dye-releasing materials associated therewith only after processing and lowering of the pH of said assemblage.

18. The photographic assemblage of claim 17 wherein said manganous compound is located on said transparent cover sheet.

19. The photographic assemblage of claim 18 wherein said compound is present at a concentration of from about 0.005 to about 2 g/m$^2$ of cover sheet.

20. The photographic assemblage of claim 17 wherein said manganous compound is located in said alkaline processing composition.

21. The photographic assemblage of claim 20 wherein said compound is present at a concentration of from about 0.01 to about 30 g/l of processing composition.

22. The photographic assemblage of claim 17 wherein said manganous compound is manganous chloride, manganous fluoride, manganous bromide, manganous nitrate, manganous acetate, manganous tartrate, manganous citrate, manganous benzoate, manganous lactate, manganous formate, or manganous sulfate.

23. The photographic assemblage of claim 17 wherein said manganous compound is manganous chloride.

24. The photographic assemblage of claim 17 wherein said manganous compound is manganous fluoride.

25. In a process for producing a photographic transfer image in color from an imagewise exposed photosensitive element comprising a support having thereon at least one silver halide emulsion layer having associated therewith a redox dye-releasing material, said process comprising treating said element with an alkaline processing composition in the presence of a silver halide developing agent to effect development of each of said exposed silver halide emulsion layers, whereby an imagewise distribution of redox dye releasing material is formed as a function of development and at least a portion of it diffuses to a dye image-receiving layer to provide said transfer image, the improvement comprising diffusing a manganous compound to said emulsion layer and said redox dye-releasing material associated therewith only after processing and lowering of the pH of said assemblage to minimize additional dye release after termination of development, said manganous compound not being initially located in the photosensitive portion of said photosensitive element.

26. The process of claim 25 wherein said manganous compound is manganous chloride, manganous fluoride, manganous bromide, manganous nitrate, manganous acetate, manganous tartrate, manganous citrate, manganous benzoate, manganous lactate, manganous formate, or manganous sulfate.

27. In a cover sheet comprising a transparent support having thereon, in sequence, a neutralizing layer and a timing layer, the improvement wherein said cover sheet also contains a manganous compound which is manganous chloride, manganous fluoride, manganous bromide, manganous nitrate, manganous acetate, manganous tartrate, manganous citrate, manganous benzoate, manganous lactate, manganous formate, or manganous sulfate.

28. The cover sheet of claim 27 which also has a dye image-receiving layer located over said timing layer.

29. The cover sheet of claim 27 wherein said manganous compound is manganous fluoride.

30. The cover sheet of claim 27 wherein said manganous compound is manganous chloride.

* * * * *